US010538903B2

(12) United States Patent
Franzén

(10) Patent No.: US 10,538,903 B2
(45) Date of Patent: Jan. 21, 2020

(54) SINK PLUG ARRANGEMENT

(71) Applicant: Oy Prevex AB, Nykarleby (FI)

(72) Inventor: Hans Franzén, Nyköping (SE)

(73) Assignee: OY PREVEX AB, Nykarleby (FI)

( * ) Notice: Subject to any disclaimer, the term of this patent is extended or adjusted under 35 U.S.C. 154(b) by 0 days.

(21) Appl. No.: 15/077,958

(22) Filed: Mar. 23, 2016

(65) Prior Publication Data

US 2016/0201307 A1 Jul. 14, 2016

Related U.S. Application Data

(63) Continuation of application No. PCT/EP2014/070223, filed on Sep. 23, 2014.

(30) Foreign Application Priority Data

Sep. 25, 2013 (EP) ..... 13186006

(51) Int. Cl.
*E03C 1/23* (2006.01)
*A47K 1/14* (2006.01)

(52) U.S. Cl.
CPC ..... *E03C 1/2302* (2013.01); *A47K 1/14* (2013.01); *E03C 2001/2311* (2013.01)

(58) Field of Classification Search
CPC ..... A47K 1/14; E03C 2001/2311
See application file for complete search history.

(56) References Cited

U.S. PATENT DOCUMENTS 2,454,333 A * 11/1948 Moon ..... E03C 1/23 251/129.01
2,736,040 A 2/1956 MacKey
3,652,054 A * 3/1972 Layton ..... F16K 31/0655 251/65
4,692,948 A 9/1987 Martin
5,208,921 A * 5/1993 Nicoll ..... E03C 1/23 4/286
5,640,724 A * 6/1997 Holmes ..... A47K 1/14 4/295
6,282,730 B1 * 9/2001 Duncan ..... A47K 1/14 251/65
7,517,452 B2 4/2009 Chapman et al.
2009/0255041 A1 * 10/2009 Duncan ..... E03C 1/2304 4/295

(Continued)

FOREIGN PATENT DOCUMENTS

CN 101614035 B 12/2010
DE 2708893 A * 8/1979 ..... A47K 1/14
EP 2037050 A1 3/2009

(Continued)

OTHER PUBLICATIONS

Machine Translation of DE 2708893, retrieved Nov. 13, 2018.*

*Primary Examiner* — Janie M Loeppke
(74) *Attorney, Agent, or Firm* — Gabriela B. Tomescu, Esq.; Bergenstråhle & Partners AB

(57) ABSTRACT

A sink plug arrangement comprises a first permanent magnet arranged to counteract movement of a sink plug within a sink outlet, wherein said sink plug is movable between a first and second state relative the sink outlet. A second permanent magnet arranged to, in the second state, repel the first magnet. A well-defined position is thereby achieved without any moving parts in the sink plug.

14 Claims, 3 Drawing Sheets

(56) References Cited

U.S. PATENT DOCUMENTS

2013/0312177 A1* 11/2013 Tong ..... E03C 1/2302
4/689

FOREIGN PATENT DOCUMENTS

| | | | |
|---|---|---|---|
| GB | 776320 | A | 6/1957 |
| NL | 1036023 | C | 4/2010 |
| WO | 2012/174163 | A2 | 12/2012 |

* cited by examiner

SINK PLUG ARRANGEMENT

This application is the continuation of international Application No. PCT/EP2014/070223, filed 23 Sep. 2014, which claims the benefit of European patent application EP 13186006.6, filed 25 Sep. 2013, the entire contents of which are hereby incorporated by reference.

TECHNICAL FIELD

The present invention relates generally to a magnetic sink plug or sink stopper for preventing or allowing liquid to pass through a sink outlet.

BACKGROUND ART

Sinks, such as sinks for restrooms or kitchens, typically comprise sink plugs or sink stoppers that are used to facilitate two states, the first stopping water from leaving through the sink outlet and the second allowing it. Sink plugs are during use subject to water, salt, grease, and many other substances disposed of through sinks creating a hostile environment for moving parts. In prior art it is well known to use such moving parts or mechanical means in order to retain a sink plug in the open and/or closed state within a sink outlet. One of the arrangements used in prior art includes a small spring loaded ball retaining the sink plug in predetermined states.

It is further known to counteract movement of a sink plug in a closed and/or an open state through the use of permanent magnets. Such arrangements minimize the use of mechanically moving parts and improve reliability.

It is well known for such arrangements to use a permanent magnet which is attracted to the material of the sink in combination with gravity to enable the opened and closed states. A permanent magnet is arranged within the sink plug which at a closed state is attracted by the sink material meanwhile in an open state only subject to gravity. It is further known to arrange different permanent magnets for the open and closed state where each permanent magnet is located to retain the sink plug in each state.

One problem with the solution for conventional sink plug arrangements comprising moving parts or mechanical means is that the hostile environment tends to affect their performance. This increases the risk of failure and it is a well known problem that moving parts within sink outlets easily get stuck or fails to achieve their purpose.

The failure of mechanical parts affects the ability of the sink plug to stay in an open position or to effectively seal the sink outlet. Similar problems occur in solutions where one permanent magnet is used to attract the material of the sink in order for the sink plug to stay in a closed or open state. The magnet creates only one distinctive state while the other becomes an arbitrary state where the magnet doesn't apply any force on the sink plug. This may cause problems with achieving sufficient sealing properties or causing the sink plug to becoming difficult to attach at each state due to residue or waste in the sink outlet.

SUMMARY OF INVENTION

An object of the present invention is to provide a sink plug arrangement that eliminates any moving parts in order to improve the durability of the sink plug arrangement. Another object of the present invention is to provide a convenient sink plug that is easy to use and that utilizes two distinctive states that are not affected by the hostile environment of a sink outlet.

These objects are achieved by the sink plug arrangement as set forth in the appended claims.

Thus, the present invention provides a sink plug arrangement comprising a first magnet arranged to counteract movement of a sink plug within a sink outlet, wherein said sink plug is movable between a first and second state relative the sink outlet, the arrangement being characterized by a second magnet arranged to, in the second state, repel the first magnet.

In one embodiment, the first magnet is provided in the stem and preferably vertically oriented. This allows for easy adaption of existing arrangements, particularly if the second magnet is a ring magnet, such as a ferrite ring magnet, surrounding the stem of the sink plug during operation of the sink plug arrangement.

In one embodiment, a fixed cylinder is arranged to receive the stem of the sink plug. This stem can be used as a support for a ring magnet, such as the second magnet is located outside the cylinder, whereby the first and second magnets can easily be added to existing installations. The second magnet can also be part of the cylinder so that the inventive functionality can be provided by simply replacing an existing, non-magnetic cylinder with a magnetic one.

In one embodiment, the second magnet is arranged adjacent to the stem of the sink plug during operation of the sink plug arrangement, so that the magnetic force between the two magnets provides a desired functionality.

In one embodiment, in the first state of the sink plug, the polarities of the first magnet and the second magnet make the magnets attract each other. This provides a well-defined first position of the sink plug. This is preferably achieved by orienting the second magnet horizontally with one pole facing the first magnet. Alternatively, in the first state of the sink plug, the polarities of the first magnet and the second magnet make the magnets repel each other. This may provide for a simpler design, with the second magnet oriented vertically, with one pole facing upward and the other pole facing downward. This may advantageously be combined with a ring magnet as the second magnet.

In a preferred embodiment, the first and second states are substantially opened and closed states relative a longitudinal axis of the sink outlet.

In a preferred embodiment, at least one of the first and second magnets is a permanent magnet, which allows for a simple and inexpensive design.

BRIEF DESCRIPTION OF DRAWINGS

The invention is now described, by way of example, with reference to the accompanying drawings, in which.

DETAILED DESCRIPTION OF EMBODIMENTS

In the following, a detailed description of the different embodiments of the invention is disclosed under reference to the accompanying drawings. All examples herein should be seen as part of the general description and are therefore possible to combine in any way in general terms. Individual features of the various embodiments may be combined or exchanged unless such combination or exchange is clearly contradictory to the overall function of the sink plug arrangement. Also, in this description the terms sink plug and strainer will be used interchangeably.

Briefly described, the invention relates to a sink plug arrangement constituting the connecting device between the sink outlet and the drain. The purpose of the sink plug arrangement is to provide means for allowing two states, one in which liquid is allowed to pass through the sink outlet and one where liquid is retained within the sink by prohibiting the liquid from passing through the sink outlet.

Figure 1:
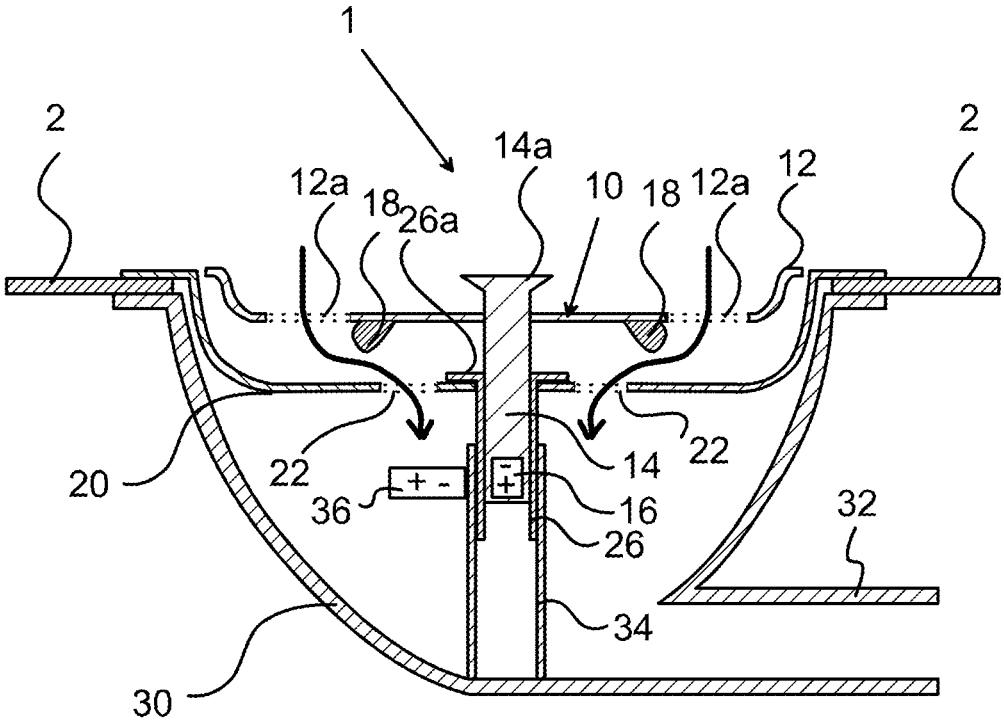
FIG. 1 shows a sectional view of a sink plug arrangement according to a first embodiment, where the sink plug or strainer is in a first upper state.
Figure 2:
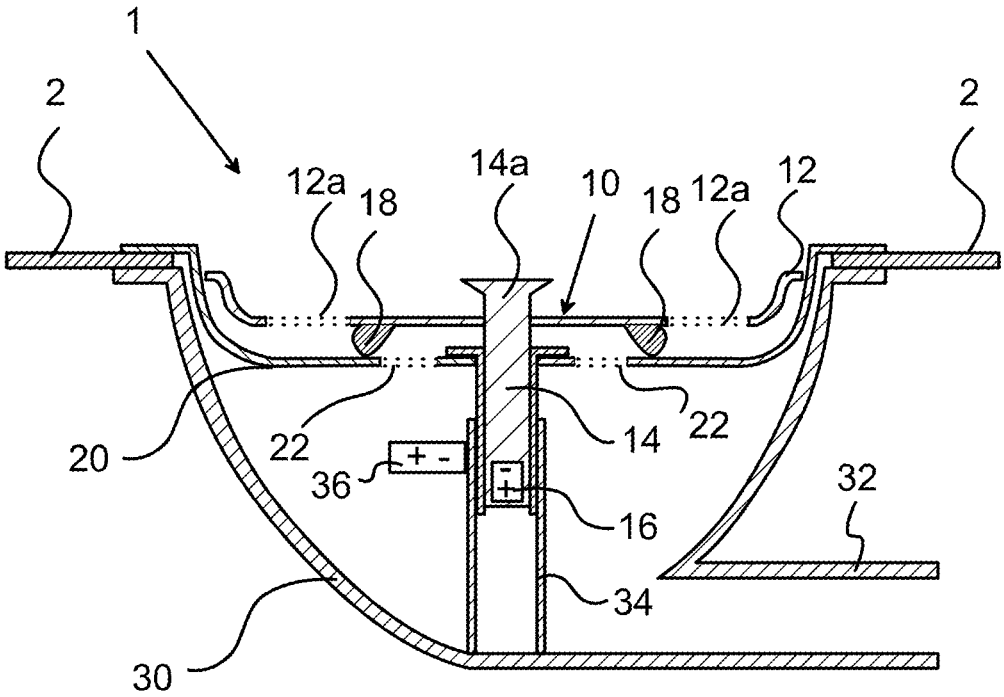
FIG. 2 shows a sectional view of a sink plug arrangement shown in FIG. 1, where the sink plug is in a second lower state.
Figure 3:
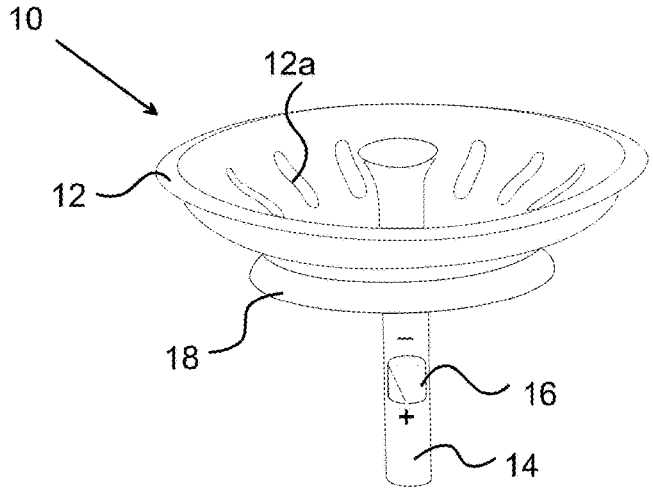
FIG. 3 shows a perspective view of the sink plug and cylinder shown in FIGS. 1 and 2.
Figure 3:
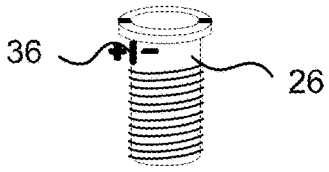

In FIGS. 1 to 3 a first embodiment of a sink plug arrangement according to the invention is shown illustrating the sink plug arrangement, generally designated 1. A sink plug or strainer 10 is a part of the sink plug arrangement 1 and is in FIG. 1 shown in an open state where liquid is allowed to pass, via a strainer basket 20, through a sink outlet 30, which in turn is attached to a drain (not shown).

The strainer 10 comprises a circular sieve 12, see also FIG. 3, provided with a plurality of circumferentially spaced apart holes 12*a*, shown with dashed lines in FIGS. 1 and 2. A stem 14 is centrally attached to the sieve 12 and is during operation vertically oriented in the sink outlet 30. The upper end portion of the stem is shaped as a knob 14*a* adapted to be gripped by a user of the sink plug arrangement. A first magnet 16, preferably a permanent magnet, is provided in the stem close to the lower end thereof. The first magnet 16 is vertically oriented with in the described example the negative pole facing upward and the positive pole facing downward. Finally, a circular seal 18 is provided on the lower side of the circular sieve 12 radially inside of the circumferentially spaced apart holes 12*a*.

The basket 20 rests on the rim of a circular hole provided in the sink 2 and is provided with a plurality of spaced apart holes 22 provided radially inside of the holes 12*a* in the strainer 10. The basket 20 is provided with a central hole adapted to receive a fixed cylinder 26 with a flange 26*a* at the upper end thereof. The cylinder, which is arranged to receive the stem 14 of the sink plug 10. is at its outer surface provided with threads adapted to cooperate with the sink outlet 30, as will be described hereinafter.

The sink outlet 30 is essentially bowl-shaped and is provided with an outlet pipe 32 adapted to connect to drain pipes (not shown). Centrally attached to the bottom of the bowl-shaped outlet is a bottom cylinder 34 with inner threads adapted to cooperate with the outer threads of the cylinder 26. The rim of the bowl-shaped outlet 30 is adapted to rest on the lower surface of the sink 2 which thereby is sandwiched between the basket 20 and the outlet 30. By screwing the cylinder 26 into the bottom cylinder 34 the sink 2 is clamped between these two parts, thereby securing the sink plug arrangement into position. Finally, the sink outlet 30 is provided with a second magnet 36, preferably a permanent magnet, arranged adjacent to the stem 14 of the strainer 10 during operation of the sink plug arrangement. The term adjacent should in this context be interpreted as being close enough so that the first and second magnets affect each other. In this first embodiment, the second magnet 36 is horizontally oriented with one pole, in the described example the negative pole, facing the first magnet 16.

The sink plug arrangement 1 is shown in FIG. 1 illustrating a first state where the strainer 10 is in an upper open state allowing water to leave the sink 2 through the sink plug arrangement 1, as indicated by the arrows. In this state, the polarities of the first magnet 16 and the second magnet 36 make the magnets attract each other. The attractive force of the magnets keeps the strainer 10 in the upper position shown in FIG. 1. In connection with this it should be appreciated that the stem 14 of the strainer 10 is vertically movable within the bore of the cylinder 26.

The sink plug arrangement 1 is further shown in FIG. 2 illustrating a second state of the first embodiment where the strainer 10 is in a lower closed state and thereby prevents water from leaving the sink 2 through the sink plug arrangement 1. When the strainer 10 is pushed from its upper position downward by a user, for example by exerting a downward force on the grip 14*a*, the first permanent magnet 16 passes the second permanent magnet 36. When the first permanent magnet 16 is below the second permanent magnet 36, as shown in FIG. 2, the repellant or repulsing force between the magnets forces the strainer 10 downward to the lower end position shown in FIG. 2. The strainer 10 can be returned to its upper open position by a user pulling the grip 14*a* upward.

In this second state the polarity of the permanent magnets 16, 36 are repulsing each other and thereby retaining the strainer 10 in a lower, closed state. This enables the strainer 10 to create a tight seal with the basket 20 preventing liquid from leaving the sink 2. This is further enhanced by the seal 18.

In FIG. 3 the strainer 10 is shown in perspective together with the cylinder 26 with the second permanent magnet 36 attached thereto. The permanent magnet could be part of the cylinder 26 itself, i.e., the cylinder could partly or entirely be formed from a magnetic material.

Figure 6:
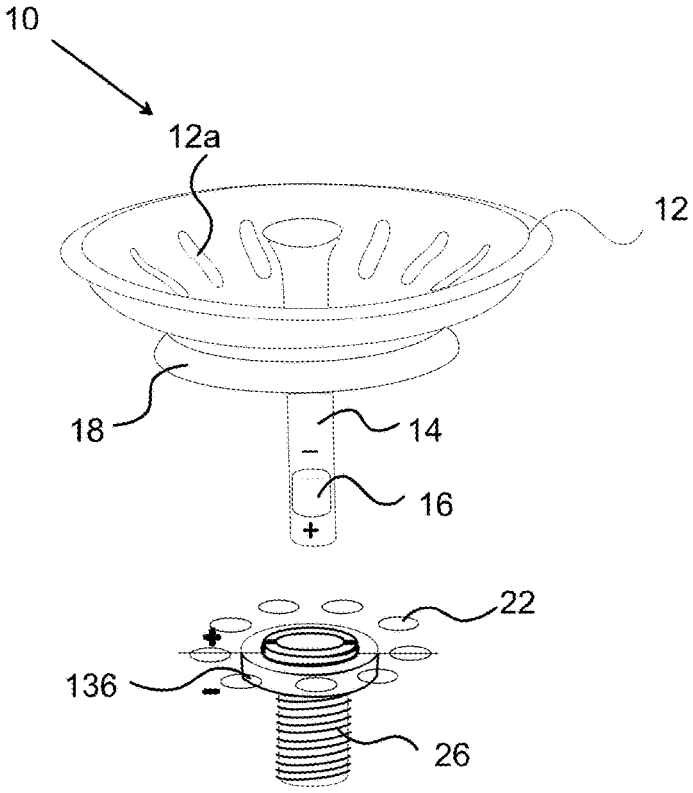
FIG. 6 shows a perspective view of the sink plug and cylinder shown in FIGS. 4 and 5.
Figure 4:
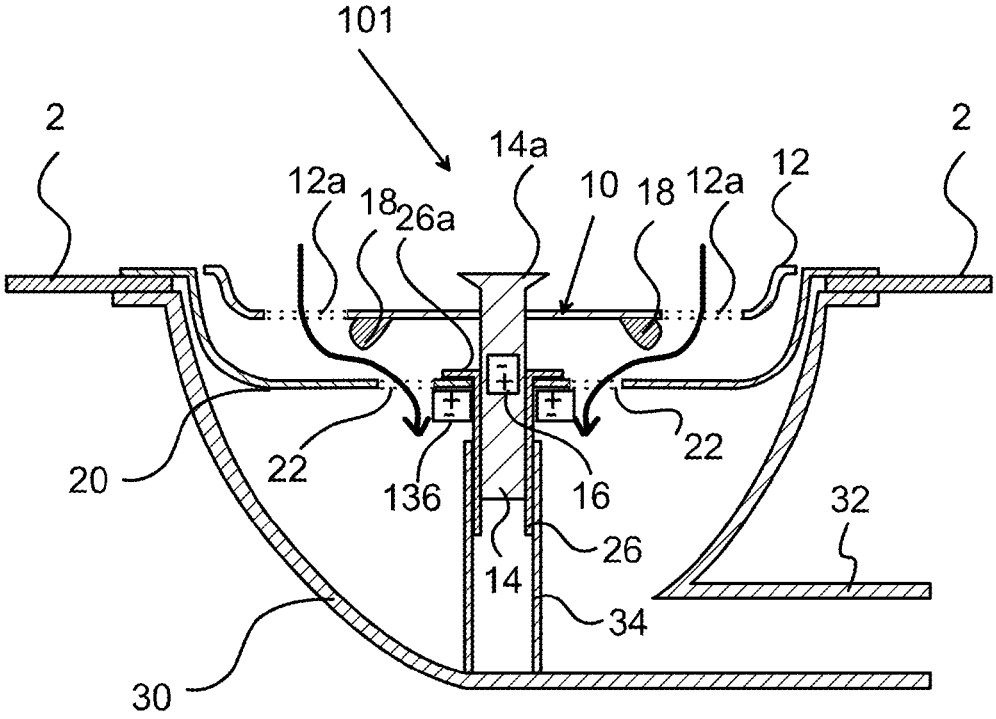
FIG. 4 shows a sectional view of a sink plug arrangement according to a second embodiment, where the sink plug or strainer is in a first upper state.
Figure 5:
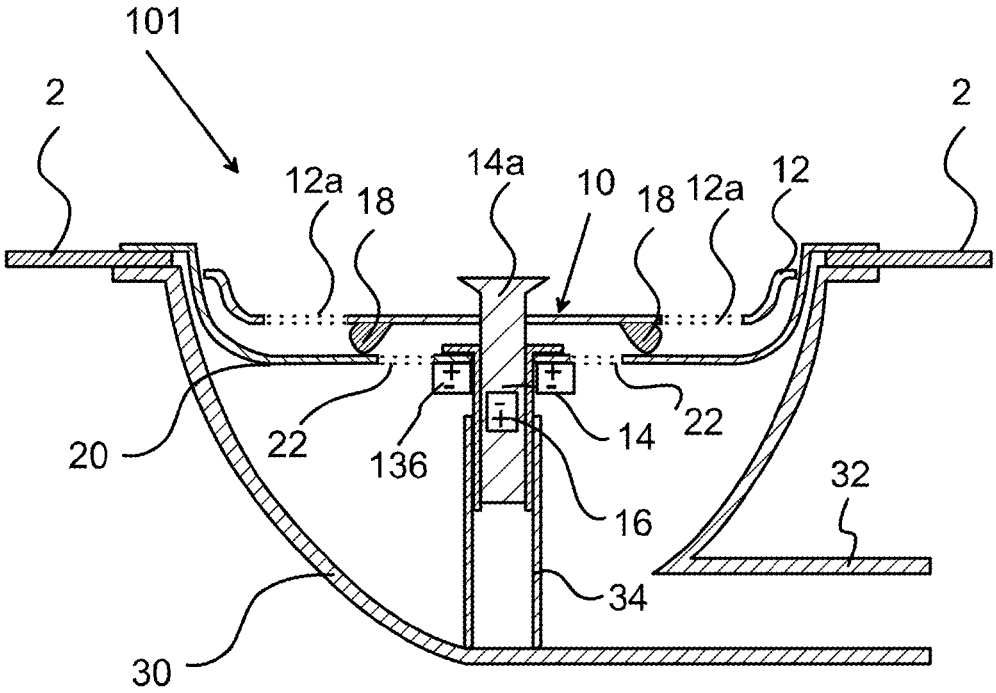
FIG. 5 shows a sectional view of a sink plug arrangement shown in FIG. 4, where the sink plug is in a second lower state.

FIGS. 4-6 illustrate a second embodiment wherein the second magnet, designated 136, preferably a permanent magnet, is located substantially surrounding the cylinder 26 and therewith the stem 14 of the sink plug 10 during operation of the sink plug arrangement 101. The second permanent magnet 136 is preferably of a ring type, preferably a ferrite ring type. This means that the second magnet is oriented vertically, with one pole facing upward and the other pole facing downward. In the described example, the positive pole is facing upward and the negative one is facing downward, but the same function is achieved if both the first magnet and the second magnet change orientation. All other parts remain the same as in the first embodiment described above with reference to FIGS. 1-3, although this second embodiment operates in a slightly different way as compared to the first embodiment.

FIG. 4 shows the second embodiment of a sink plug arrangement, generally designated 101, wherein the strainer 10 in an upper open position. In this embodiment this maintained by the repellant force between the first permanent magnet 16 provided in the stem 14 of the strainer 10 and the second permanent magnet 136 provided as a collar around the cylinder 26 and thereby around the stem 14. In a sense, the strainer 10 levitates on the magnetic field created by the circular permanent magnet 136.

When the strainer 10 is pushed downward by a user, for example by exerting a downward force on the grip 14*a*, the first permanent magnet 16 passes through the second permanent magnet 136. When the first permanent magnet 16 is below the second permanent magnet 136, as shown in FIG. 5, the repellant force between the magnets forces the strainer 10 downward to the lower end position shown in FIG. 5. The strainer 10 can be returned to its upper open position by a user pulling the grip 14*a* upward.

The second embodiment is further appreciated by the perspective view of the strainer 10 and the second permanent magnet of FIG. 6.

In both the first embodiment and the second embodiment the strainer 10 is maintained in its lower closed position by the repellant force between the first permanent magnet provided in the stem 14 of the strainer 10 and the fixed second permanent magnet 36 and 136, respectively. In the first embodiment the upper open position of the strainer 10 is maintained by the attractive force between the first and second permanent magnets 16, 36 while in the second embodiment the upper open position of the strainer 10 is maintained by the repellant force between the first and second permanent magnets 16, 136. However, in both embodiments the operation of the sink plug arrangement 1 and 101, respectively, works smoothly without any moving parts and with a well-defined closed position of the strainer 10.

Preferred embodiments of a sink plug arrangement have been described. It will be realized that these can be varied without departing from the inventive idea defined by the appended claims. It is thus understood that the polarity of all the permanent magnets for the assembly of the sink plug arrangement may be switched as well as the repulsing force in relation to the attracting force can be applied on either the first or the second state. Also, the exact positions of the permanent magnets may vary in order to achieve the desired attractive and/or repulsive forces between the magnets.

Sink plug arrangements with threaded cylinders for the assembly of the arrangement and the guidance of the sink plug or strainer have been shown. It will be appreciated that the inventive idea as defined by the appended claims is applicable to arrangements lacking these parts as long as first and second magnets are provided for maintaining the sink plug in upper and lower positions.

The described second embodiment is provided with a ring magnet. It will be appreciated that this can be replaced by one or several vertically oriented magnets provided adjacent to the stem of the sink plug. For example, a plurality of spaced apart magnets can be provided oriented vertically surrounding or essentially surrounding the stem of the sink plug during operation thereof.

Although in both the described embodiments the first and second magnets repel each other, it will be appreciated that the first embodiment can be modified so that the magnets attract each other in the lower end position of the sink plug. This is achieved by providing the second magnet lower than shown in the figures and switching the polarities of the first magnet.

The invention claimed is:

1. A sink plug arrangement comprising a first magnet arranged to counteract a movement of a sink plug within a sink outlet, wherein said sink plug is movable between a first, upper state and second, lower state relative the sink outlet, and wherein the sink plug is provided with a stem which during operation is vertically oriented in the sink outlet, and a knob adapted to be gripped by a user of the sink plug arrangement, wherein a second, fixed magnet is arranged to, in the second, lower state, repel the first magnet, so that the sink plug arrangement is maintained in its lower state by the repellant force between the first and second magnets, wherein the first magnet is provided in the stem.

2. The sink plug arrangement according to claim 1, comprising a fixed cylinder arranged to receive the stem of the sink plug.

3. The sink plug arrangement according to claim 2, wherein the second magnet is part of the cylinder.

4. The sink plug arrangement according to claim 2, wherein the second magnet is located outside the cylinder.

5. The sink plug arrangement according to claim 1, wherein the first magnet is oriented with one pole facing upward and the other pole facing downward.

6. The sink plug arrangement according to claim 1, wherein the second magnet is arranged adjacent to the stem of the sink plug during operation of the sink plug arrangement.

7. The sink plug arrangement according to claim 1, wherein, in the first state of the sink plug, the polarities of the first magnet and the second magnet make the magnets attract each other.

8. The sink plug arrangement according to claim 7, wherein the second magnet is oriented with one pole facing the first magnet.

9. The sink plug arrangement according to claim 1, wherein, in the first state of the sink plug, the polarities of the first magnet and the second magnet make the magnets repel each other.

10. The sink plug arrangement according to claim 1, wherein the second magnet is located substantially surrounding the stem of the sink plug during operation of the sink plug arrangement.

11. The sink plug arrangement according to claim 10, wherein the second magnet is a ring magnet.

12. The sink plug arrangement according to claim 1, wherein the second magnet is oriented with one pole facing upward and the other pole facing downward.

13. The sink plug arrangement according to claim 1, wherein the first and second states are substantially opened and closed states relative a longitudinal axis of the sink outlet.

14. The sink plug arrangement according to claim 1, wherein at least one of the first and second magnets is a permanent magnet.

* * * * *